US005868252A

United States Patent [19]

Oliff

[11] Patent Number: 5,868,252

[45] Date of Patent: Feb. 9, 1999

[54] DIVIDER PANEL WITH ANCHOR PANEL WINDOW APERTURE

[75] Inventor: James R. Oliff, Douglasville, Ga.

[73] Assignee: The Mead Corporation, Dayton, Ohio

[21] Appl. No.: 857,743

[22] Filed: May 15, 1997

[51] Int. Cl.[6] ..... B65D 71/00

[52] U.S. Cl. ..... 206/427; 229/120.32; 229/162

[58] Field of Search ..... 206/139, 162, 206/427, 430, 432, 767, 769, 821; 229/120.32, 120.38, 162

[56] References Cited

U.S. PATENT DOCUMENTS

| | | | |
|---|---|---|---|
| 2,671,584 | 3/1954 | Taylor, Jr. | 206/486 |
| 3,937,326 | 2/1976 | Schick | 206/482 |
| 4,307,806 | 12/1981 | Haubert | 206/486 |
| 4,503,975 | 3/1985 | Meyers et al. | 206/486 |
| 4,773,540 | 9/1988 | Schuster | 206/427 |
| 5,427,242 | 6/1995 | Oliff et al. | 206/430 |
| 5,437,143 | 8/1995 | Culpepper et al. | 53/445 |
| 5,518,111 | 5/1996 | Stout | 206/160 |
| 5,682,984 | 11/1997 | Hoell et al. | 207/427 |

*Primary Examiner*—Jim Foster
*Attorney, Agent, or Firm*—Michael V. Drew

[57] ABSTRACT

A divider panel (10, 11) has a major panel (12) with an anchor flap (14) foldably adjoining an edge thereof. The anchor panel (14) has an aperture (16) which is positioned for alignment with an aperture (8) in a carton (7) in which the divider panel (10, 11) is disposed.

2 Claims, 2 Drawing Sheets

DIVIDER PANEL WITH ANCHOR PANEL WINDOW APERTURE

TECHNICAL FIELD OF THE INVENTION

The invention relates generally to packages of articles arranged in two or more tiers separated by a divider panel which has an anchor flap, and more particularly to a divider panel for use with a carton having a wall with an aperture therethrough for viewing the interior of the carton wherein the anchor flap of the divider panel has an aperture therethrough positioned for alignment with the aperture in the carton wall such that packaged articles are visible through the carton wall and anchor flap apertures.

BACKGROUND OF THE INVENTION

A divider panel often has an anchor flap which is positioned to be sandwiched between some of the articles which are packaged and a wall of the carton which forms a part of the package. Divider panels with anchor flaps are disclosed in patents such as U.S. Pat. No. 5,518,111. Anchor flaps are useful for helping to maintain the position of the divider panel as a package is created. An anchor flap is also useful for helping to remove the divider panel from a package.

Often in the packaging field it is desirable to have a carton which displays at least a portion of the contents of the carton. Partial display of the contents of a carton can be achieved through use of an aperture which extends through a wall of the carton. A convenient means for providing an aperture through a carton wall is to provide for the aperture in a composite wall of the carton. For example, an aperture is very simply provided in an end wall of an end-loaded carton by providing end flaps which are short enough to leave an opening when the flaps are brought together and/or overlapped to create a composite end wall. A suitable viewing aperture may also provided by a cut-out portion of a carton wall. Because the anchor flap of a divider panel is normally disposed in face-contacting relationship with a carton wall, it would be useful to have a divider panel with an anchor flap that would be compatible with a carton having a viewing aperture such that the anchor flap would not obstruct the carton viewing aperture.

SUMMARY OF THE INVENTION

According to a preferred embodiment of the invention a divider panel has a major panel with an anchor flap foldably adjoining an edge thereof. The anchor panel has an aperture which is positioned for alignment with an aperture in a wall of a carton in which the divider panel is disposed.

Other features and advantages of the invention will be apparent from the following description, the accompanying drawings, and the appended claims.

DETAILED DESCRIPTION OF THE PREFERRED EMBODIMENT OF THE INVENTION

Figure 1:
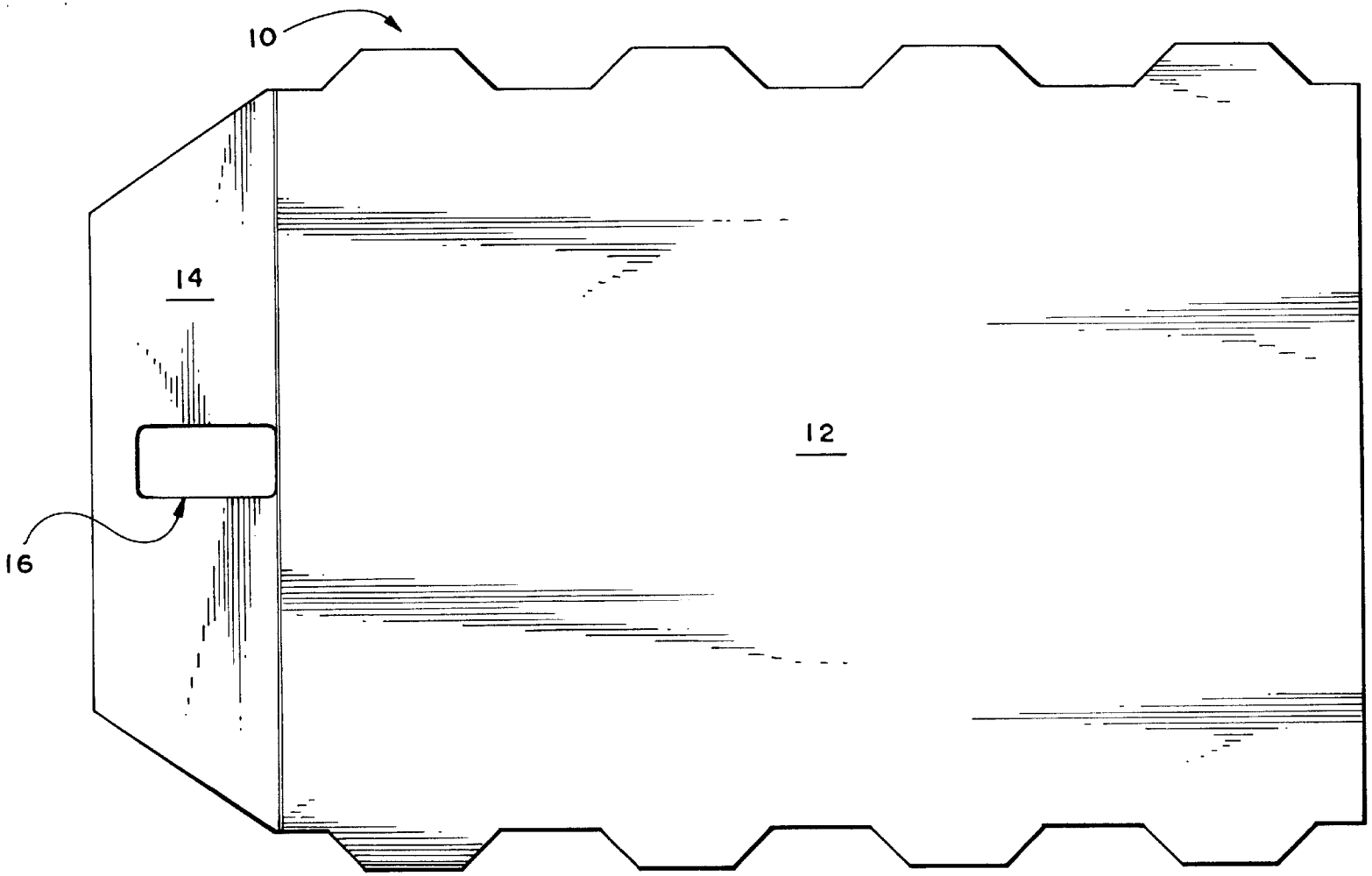
FIG. 1 is a plan view illustration of a divider panel according to a preferred embodiment of the invention.

Throughout the figures the same reference numerals are used to refer to identical features of the preferred embodiment illustrated.

Referring first to FIG. 1, therein is illustrated a divider panel 10 according to a preferred embodiment of the invention. The divider panel 10 has a major panel 12 to which an anchor flap 14 is foldably joined along an edge. The invention contemplates that a divider panel may have several anchor flaps adjoined around its perimeter. However, for purposes of discussion and illustration of the invention only one anchor flap is shown. The anchor flap 14 has an aperture 16. The aperture 16 is positioned for alignment with an aperture, or window, 8 in a carton wall, which will be discussed in more detail below.

Figure 2:
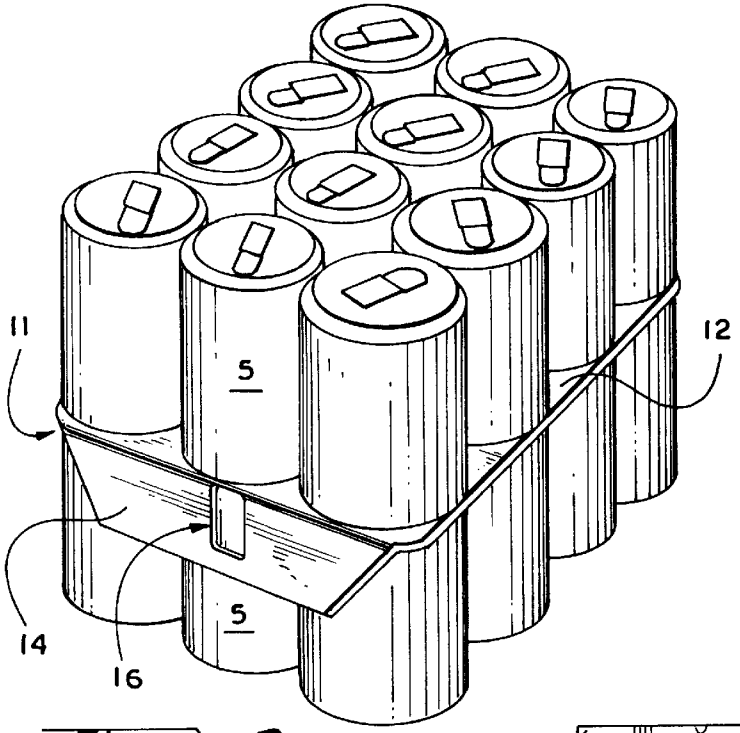
FIG. 2 is an isometric illustration of a group of articles having two tiers separated by a divider panel according to a preferred embodiment of the invention.

Referring now to FIG. 2, therein is shown a group of articles 5, such as beverage cans, arranged in two tiers separated by a divider panel 11 according to a preferred embodiment of the invention. Two parallel edges of the divider panel 10 in FIG. 1 have an undulating configuration while in the divider panel 11 of FIG. 2 those edges are straight. These are inconsequential differences in relation to the operation of the present invention but do illustrate that the features of the invention are applicable to divider panels incorporating other features. In FIG. 2, the divider panel 11 is positioned with the major panel 12 separating adjacent tiers of articles 5. The anchor flap 14 is folded downward where it is essentially in perpendicular relationship with respect to the major panel 12. The arrangement of the group of articles 5 and divider panel 11 is typical for insertion thereof into a carton. Although the anchor flap 14 is shown pivoted downward, it may also be pivoted upwardly or generally 180 degrees from its illustrated position to accomplish a comparable result. One of the articles 5 in the lower tier is visible through the aperture 16 of the anchor flap 14.

Figure 3:
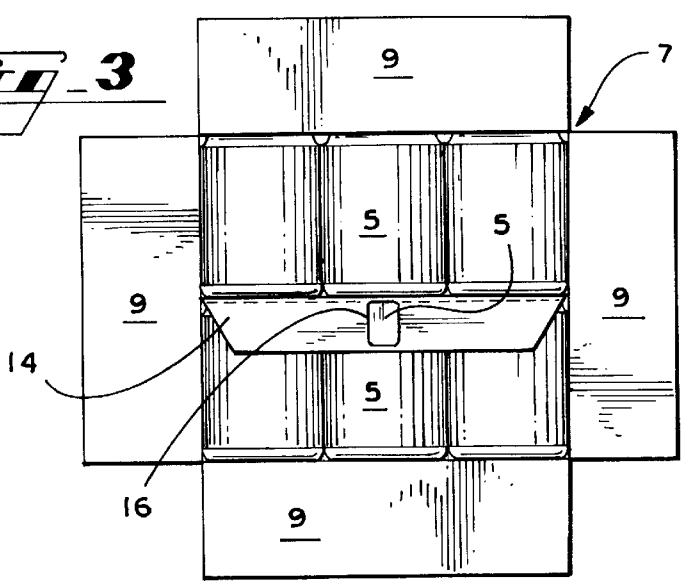
FIG. 3 is an end view of a package containing the articles and divider panel of FIG. 2, with the end flaps of the carton opened outward.

Referring now to FIG. 3, therein is shown the divider panel 11 and articles 5 of FIG. 2 placed within a carton 7 to form a package. The end flaps 9 of the carton 7 are shown in an open position so that the contents of the carton 7 may clearly seen. The anchor flap 14 is shown folded down into perpendicular disposition with respect to the major panel 12. An article 5 remains visible through the aperture 16.

Figure 5:
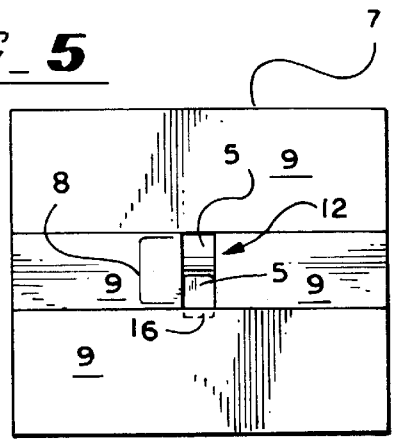
FIG. 5 is the same view as FIG. 4 but with most of the dotted lines removed for clarity.
Figure 4:
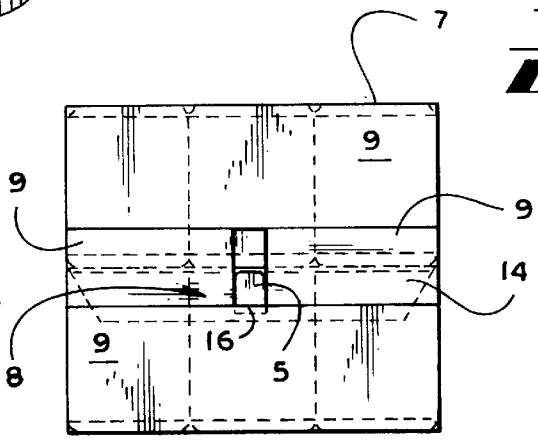
FIG. 4 is the same view as FIG. 3 but with the end flaps of the carton closed to form an end wall.

Referring now to FIG. 4, it can be seen that the end flaps are configured such that when the end flaps 9 are folded and overlapped to a closed position a window, or aperture, 8 is formed. The articles 5 and most of the divider panel 11 are illustrated in dotted lines as features hidden by the end flaps 9. It can be seen that the configuration and disposition of the aperture 16 of the divider panel 11 causes the divider panel aperture 16 to be in alignment with the window/aperture 8 of the carton 7 wall when the package is formed. Referring now to FIG. 5, for clarity, the view of FIG. 4 is repeated with most of the dotted lines removed.

The window formed by the aligned apertures 8, 16 provides a view into the carton 7. The window 8/16 may also be used as a marketing tool when it is desirable to interrelate the articles 5 viewed through the window 8/16 with graphics displayed on the outer surface of the carton wall.

It is to be noted that although the carton window is shown as being formed by overlapping flaps which form a composite wall the carton aperture 8 may also be a cut-out portion in a composite or single-ply carton wall. It is also to be noted that in the preferred embodiment illustrated the anchor flap 14 can also be folded upward and still perform as anticipated by the invention. It is further noted that either or both of apertures may be of a configuration other than the rectangular configuration shown in the drawings.

Other modifications may be made in the foregoing without departing from the scope and spirit of the claimed invention.

What is claimed is:

1. Packaging for a plurality of articles of a predetermined height arranged in a group of at least two tiers comprising:

a carton for encasing the articles, said carton having at least one wall having a first aperture therethrough disposed for viewing an interior of said carton; and a divider panel for separating adjacent tiers of the articles, said divider panel having a major panel for being disposed between the adjacent tiers and having an anchor flap foldably adjoined to said major panel, said anchor flap having a second aperture therethrough;

wherein when said major panel is disposed in the carton at a height of a lower tier of articles and said anchor flap is folded into perpendicular relationship with respect to said major panel said second aperture is in alignment with said first aperture.

2. The packaging of claim 1, wherein said first aperture is defined in a composite wall by non-overlapping portions thereof.

* * * * *